US007937867B1

(12) United States Patent
Mehl et al.

(10) Patent No.: US 7,937,867 B1
(45) Date of Patent: May 10, 2011

(54) SIGN ASSEMBLY

(76) Inventors: William Mehl, Belmont, OH (US); Thomas L. Harbert, Ambridge, PA (US)

( * ) Notice: Subject to any disclaimer, the term of this patent is extended or adjusted under 35 U.S.C. 154(b) by 529 days.

(21) Appl. No.: 11/982,802

(22) Filed: Nov. 5, 2007

(51) Int. Cl.
*G09F 7/00* (2006.01)

(52) U.S. Cl. ..... 40/611.01; 40/606.01; 40/607.03

(58) Field of Classification Search ..... 40/607.02, 40/607.03, 611.01, 611.04, 653; 248/220.31, 248/300, 301
See application file for complete search history.

(56) References Cited

U.S. PATENT DOCUMENTS

| | | | | | |
|---|---|---|---|---|---|
| 1,041,224 | A | * | 10/1912 | Adams | 40/607.02 |
| 1,352,065 | A | * | 9/1920 | Hottenstein | 40/607.02 |
| 1,405,915 | A | | 2/1922 | Haskel | 40/611.06 |
| 1,483,067 | A | * | 2/1924 | Berry | 40/581 |
| 1,768,715 | A | | 7/1930 | Hopp | 40/653 |
| 1,942,444 | A | | 1/1934 | O'Connor | 40/592 |
| 2,345,913 | A | | 4/1944 | Bishop | 40/611.06 |
| 2,627,683 | A | | 2/1953 | Leander | 40/124.15 |
| 2,691,502 | A | * | 10/1954 | Jones | 248/243 |
| 3,015,899 | A | * | 1/1962 | Ensign et al. | 40/605 |
| 3,394,507 | A | * | 7/1968 | Doke | 52/36.6 |
| 3,407,547 | A | * | 10/1968 | Doke et al. | 52/36.6 |
| 3,838,529 | A | | 10/1974 | Aybar | 40/585 |
| 4,209,927 | A | * | 7/1980 | Donatelle | 40/607.02 |
| D278,882 | S | * | 5/1985 | Vater et al. | D8/382 |
| 4,548,377 | A | | 10/1985 | Huel | 248/219.1 |
| 4,585,131 | A | * | 4/1986 | Crossman et al. | 211/206 |
| 4,742,633 | A | | 5/1988 | Snediker | 40/607.02 |
| 4,783,921 | A | | 11/1988 | George | 40/602 |
| 4,882,866 | A | | 11/1989 | Gebhardt | 40/611.01 |
| 4,884,352 | A | | 12/1989 | Lipscomb | 40/611.01 |
| 5,215,285 | A | * | 6/1993 | Lewis | 248/457 |
| 5,335,889 | A | | 8/1994 | Hopkins et al. | 248/231.81 |
| 5,862,616 | A | * | 1/1999 | Peroni | 40/607.15 |
| 6,023,867 | A | | 2/2000 | Gagne | 40/491 |
| 6,233,858 | B1 | | 5/2001 | Brach, et al. | 40/660 |
| 6,293,035 | B1 | | 9/2001 | LaPointe | 40/607.12 |
| 6,578,302 | B1 | | 6/2003 | Benaquista et al. | 40/611.06 |
| 6,601,328 | B1 | | 8/2003 | Benaquista et al. | 40/611.06 |
| 7,587,847 | B2 | * | 9/2009 | Lasher | 40/611.01 |

OTHER PUBLICATIONS

"Board Signs, MDO Signs, & Sign Letters", downloaded from www.aztec-signs.com on Sep. 10, 2007.
Diabond product description, downloaded from www.diabond.com on Sep. 10, 2007.
Gatorboard product description, originally downloaded from www.tri-dee.com on Sep. 10, 2007.

(Continued)

*Primary Examiner* — Joanne Silbermann
*Assistant Examiner* — Christopher E Veraa
(74) *Attorney, Agent, or Firm* — Price & Adams

(57) ABSTRACT

A tab extending from a panel is inserted into a channel through an opening in a vertically aligned bracket supported by a pole. The bracket includes a pair of plates positioned in spaced overlying relation and connected by a brace to form the channel between the plates. The panel is first moved in a vertical direction until an upper tab is inserted through a slot formed by a stop positioned in the channel at a predetermined distance from the brace. The upper tab guides a notch in the panel to receive the stop until the stop contacts the bottom of the notch. Thereafter the panel is rotated in the channel until a lower tab is aligned with a second slot formed by a second stop at the opposite end of the channel. The panel is further moved until the second tab is positioned in the second slot to guide a second notch in the panel to receive the second stop and securely retain the panel in the bracket channel.

23 Claims, 9 Drawing Sheets

OTHER PUBLICATIONS

"General Properties of Corrugated Plastic Sheets|Coroplast", downloaded from www.coroplast.com on Sep. 6, 2007.
Gundberg, Trevor, "Foam Core Materials in the Marine Industry", downloaded from www.boatdesign.net on Sep. 10, 2007.
"Material Safety Data Sheet|Coroplast", downloaded from www.coroplast.com on Sep. 6, 2007.
Sintra product description, originally downloaded from www.tri-dee.com on Sep. 10, 2007.
"Understanding Sign Materials", downloaded from www.signwave.com.au on Sep. 6, 2007.

* cited by examiner

SIGN ASSEMBLY

BACKGROUND OF THE INVENTION

1. Field of the Invention

This invention relates to method and apparatus for displaying a sign and, more particularly, to method and apparatus for displaying a sign in which the sign includes a pair of vertical notches that facilitate connection to a bracket.

2. Description of the Related Art

Various devices for displaying cards, nameplates, tickets, or other objects have been disclosed. U.S. Pat. No. 1,405,915 discloses a card holder that includes a pair of spaced apart, card holding members. Each member includes an attaching portion with a laterally offset card-receiving portion. The card covers the attaching portion.

U.S. Pat. No. 3,838,529 discloses a nameplate for a directory comprising a strip and blank in which the strip is comprised of a thin, flexible, resilient deformed material having rounded ends forming lobes. The blank is a plastic engravable blank secured to the strip. Nameplates are provided which are flexible to be bent in a slight curvature and are resilient to return to that shape when flattened. The nameplate is deformed and/or positioned to cause only the strip of the nameplate to fit into and engage folded-over edge portions of a holder.

U.S. Pat. No. 1,768,715 discloses a display device for displaying price ticket holders. The ticket holders are removable. The display device includes a main body portion of elongated shape. Inwardly disposed end flanges integral with the ends of the main body portion are included. A channel member is carried by the main body portion and extends transversely in spaced relationship with the flanges. The oppositely disposed flanges are formed integral with the channel member and are adapted to cooperate with their respective end flanges to retain a ticket in display position in the main portion. Tongues are carried by the channel members and are adapted for bending around the respective side edge of the body portion to retain the price tickets in position.

U.S. Pat. No. 2,627,683 discloses a foldable display made of sheet material. The display is particularly adapted for being applied to the top of an oil pump casing. A display made of sheet material is cut, scored, and foldable to conform to a curved support. The ends of the sheet are attached together to turn both of the ends of the oval scored base downwardly to conform to oppositely curved surfaces at relatively opposite sides of the top of the supporting structure. Resilient means extend through the display and against the scored portion in its outwardly turned position and fastening clips secured to the ends of the resilient means comprising hooks adapted to engage the sides of the support with the rounded top to which the display is attached.

Sign assemblies often include a frame structure often made of metal, plastic or other materials. Typically, a sign portion is held in place by the frame structure. Very often such frame structures do not offer the ease in changing the sign portion and at the same time provide a sign portion that is securely held in place once it is positioned in the sign assembly. Very often such sign assemblies are outside and exposed to the elements or may be inside and exposed to people or other forces bumping the assembly.

U.S. Pat. No. 1,942,444 discloses an advertising sign assembly for a vehicle top. The assembly includes an essentially flat panel supported by a plurality of brackets. The brackets are secured to the vehicle top with a plurality of elastic bands.

U.S. Pat. No. 4,548,377 discloses a system for mounting signs to posts. The system includes a bracket having a plurality of sides provided with a longitudinal slot in one of its sides. The system also includes two post engaging projections on another side of the bracket and at least one opening transverse to the slot. The sign is capable of being introduced in the slot having at least one opening that is in alignment with those in the bracket. The system is securely held to the post by straps that extend through the recesses and are tightly wrapped around the post so as to retain the sign and the bracket at the same time.

U.S. Pat. No. 4,882,866 discloses a signage system support structure formed from a pair of identical extruded multi-groove channel members. A connecting element is included in the form of an elongated rigid panel inserted into an unconstricted medial groove of each channel which serves to join two channels. Each channel is additionally formed with a constructed medial groove, and a pair of outwardly facing grooves, and pair of lateral grooves on each side of and parallel to the medial grooves. In use, the upper and/or lower edges of the sign to be supported are engaged in one or more of the channel grooves with a flat sign having either opposed edges encased in the lateral grooves or a free edge in a constricted medial groove. An arcuate sign has its edges engaged in the outwardly facing grooves. The signs may be formed with engaging tabs displaceable from the plane of the sign to engage a groove.

U.S. Pat. No. 5,335,889 discloses a bracket. The bracket serves as a sign support by providing a leg and a foot. A plurality of retainers is carried by the leg and foot. The retainers hold the sign in a vertical orientation.

U.S. Pat. No. 6,023,867 discloses a selective message display system. The system includes a pair of plates facing one another and in a spaced relationship to form a space between them. The outer faces of the plates bear insignia, such as parking restriction notifications. A movable display panel is mounted between the plates. The faces of the display panel bear additional insignia that override or complement the parking restrictions on the plates.

U.S. Pat. No. 6,233,858 discloses an apparatus for providing advertising on a gas pump hose. The apparatus includes a frame having a slide located on one edge that can be slid into a housing located on a hose connector collar. The hose connector collar is connected to the gas pump hose by a clamp located at opposite ends of the hose connector collar. An advertising structure is placed within the frame and at eye level of a customer of the service station to maximize the effect of the advertisement while the customer is at the service station.

U.S. Pat. No. 6,293,035 discloses bracket for securing a sign to a position which a clamp is formed as a flanged open substantially cylindrical body having facing arms adapted to be brought together by a bolt for holding the sign. Tightening the bolt serves to attach the sign to the bracket and the bracket to the post. The sign defines a slot having an open end for allowing the sign to be inserted between the arms of the body without having to completely unscrew the bolt.

Various sign assemblies that include extended slots have also been disclosed. U.S. Pat. No. 2,345,913 discloses a display card that is mounted between two hollow tubular column members. The display card has an L-shaped slot which extends on its lateral edge on both sides of the display card. Such an arrangement allows the card to be evenly suspended from both sides. The rivets from which the display card is suspended are sufficient to support the card without the use of any additional abutment to maintain the card vertical direction.

U.S. Pat. No. 4,783,921 discloses a wind resistant sign for display purposes. The sign includes a base and a thin, resilient panel. The panel has sufficient resilience and strength to undergo bending deflection responsive to wind forces.

U.S. Pat. No. 4,884,352 discloses a changeable sign assembly. The assembly includes a base with a least two retaining members attached to the base which has walls defining opposing longitudinal grooves. A number of display members having curved opposite edge portions are formed of a thin resilient material. The edge portions are flexibly deformed by the longitudinal grooves to the retaining members so that the display members are removably retained by the retaining members.

U.S. Pat. Nos. 6,578,302 and 6,601,328 disclose a sign assembly particularly adapted for point of purchase displays. The sign assembly provides an easily changeable sign portion but when mounted remains securely in position. The sign assembly may utilize pre-existing structures for its support.

U.S. Pat. No. 4,742,633 discloses an improved modular post-mounted sign apparatus for maintaining a sign in a substantially retained fashion while providing for the facilitated assembly, disassembly and storage of the sign apparatus. A sign panel is telescopically inserted through the open end of the post into an interior cavity. A portion of the sign panel protrudes outwardly through a slot in the post. The sign panel is retained within the post's interior cavity by a flanged retaining pin assembly affixed to the portion of the sign panel. The retaining pins preclude the removal of the sign panel from the post member. A cap is removably affixed over the open first end of the post member to further retain the sign panel.

Existing sign assemblies are difficult to assemble and disassemble, so that changing the sign portion is difficult. Accordingly, there exists a need for an improved sign assembly that includes a sign portion that may be quickly and easily changed.

SUMMARY OF THE INVENTION

In accordance with the present invention there is provided a bracket for displaying a sign. A pair of plates are positioned in spaced overlying relation. A brace is positioned between and connected to the plates forming a channel between the plates. The plates are spaced a preselected distance apart to form an opening into the channel for receiving the sign. A pair of stops are secured in the channel in spaced relation at a predetermined distance from the brace to form a slot between each stop and the brace and accessible through the opening. Each of the slots receives in the channel through the opening a tongue-shaped member extending from an edge of the sign into abutting relation with the stop to retain the sign within the channel.

Further in accordance with the present invention there is provided a sign that includes a panel having a display section defined by a guide edge, an upper tabbed edge, and a lower tabbed edge. The upper tabbed edge has a notch forming an upper tab at a juncture with the guide edge. The lower tabbed edge has a notch forming a lower tab at a juncture with the guide edge. The guide edge is adapted for insertion into a bracket channel in abutting relation with the bottom of the channel. The upper tab is movable within the channel to abut a first stop positioned within the channel. The lower tab is within the channel. The upper tab and the lower tab frictionally engage the first stop and the second stop respectively to retain the panel in the channel.

Further in accordance with the present invention, there is provided a sign assembly that includes a support member and a bracket extends from the support member. The bracket has a longitudinally extending channel with a pair of stops positioned therein. A panel has a display section, a guide edge, and a pair of tabs positioned at opposite sides of the guide edge to define a pair of vertical notches. The guide edge is movable within the bracket channel to position the tabs for alignment of the notches with the stops. The stops are positioned in the notches with the guide edge abutting the bracket at the bottom of the channel to secure the panel to the bracket with the display section extending outwardly from the bracket.

Further in accordance with the present invention, there is provided a method for assembling a display apparatus that includes the steps of inserting a first tab extending from one end of a panel into a channel of a bracket to align a first notch adjacent to the first tab with a first stop positioned at one end of the channel. The first tab is guided in the channel to position the first stop in the first notch. The panel is rotated to align a second tab on the opposite end of the panel with a second stop positioned at the opposite end of the channel. The panel is moved to insert the second stop into a second notch in the panel adjacent to the second tab. The panel is extended from the channel so that a substantial portion of the panel is visible while the first tab and the second tab are retained in the channel.

Further in accordance with the present invention, there is provided a kit for assembling a sign that includes a bracket having a pair of sheets positioned in spaced overlying relation, a pair of stops, and a brace positioned between and connecting the strips to one another. The bracket sheets and the bracket stops define a channel therein. A panel has a display section and a guide section. The guide section includes a pair of tabs positioned at opposite ends of the panel to define a pair of notches. The notches have a predetermined width to receive the bracket stops after the panel guide section inserts into the bracket channel.

Accordingly, a principal object of the present invention is to provide a wind resistant sign assembly.

Another object of the present invention is to provide an improved sign assembly that permits an efficient change of signage mounted on a pole.

A further object of the present invention is to provide a bracket having a channel that receives a sign for efficient assembly and disassembly.

A further object of the present invention is to provide a sign assembly that includes a sign with vertical slots for engagement with a bracket.

These and other objects of the present invention will be more completely described and disclosed in the following specification, accompanying drawings, and appended claims.

DESCRIPTION OF THE PREFERRED EMBODIMENTS

Figure 1:
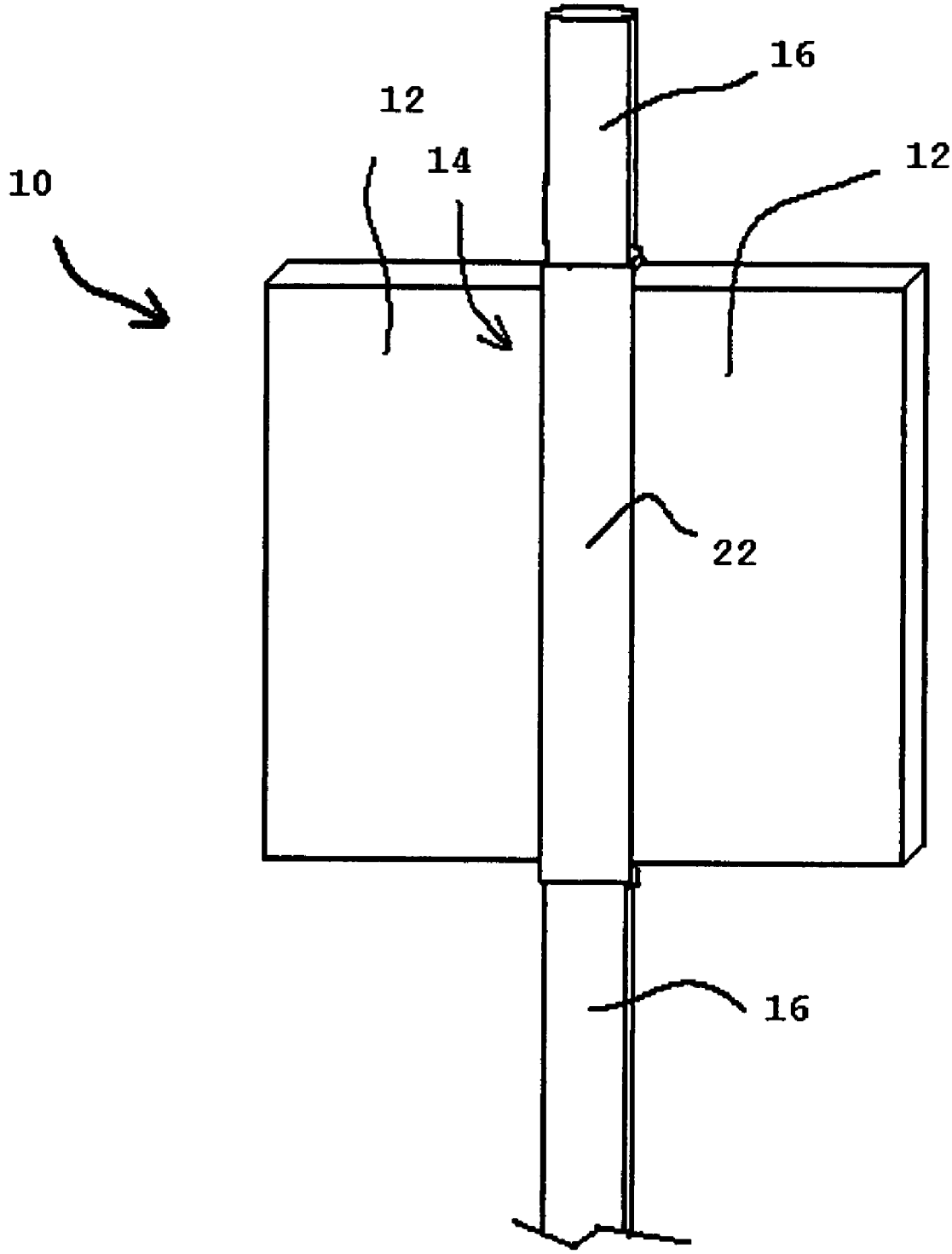
FIG. 1 is an isometric view of the sign assembly, illustrating the assembled sign connected to a pole.

Referring to the drawings and, particularly to FIGS. 1-4, there is illustrated an improved sign assembly for the display of advertising, such as outdoor advertising, generally designated by the numeral 10. The sign assembly 10 includes a sign or panel 12 that is inserted into a bracket 14 generally designated by the numeral 14 for mounting on a support member or pole 16. The bracket 14 is connected to the pole 16 using conventional fasteners. The sign 12 extends from the bracket 14 above the support member 16 at a predetermined distance.

Figure 4:
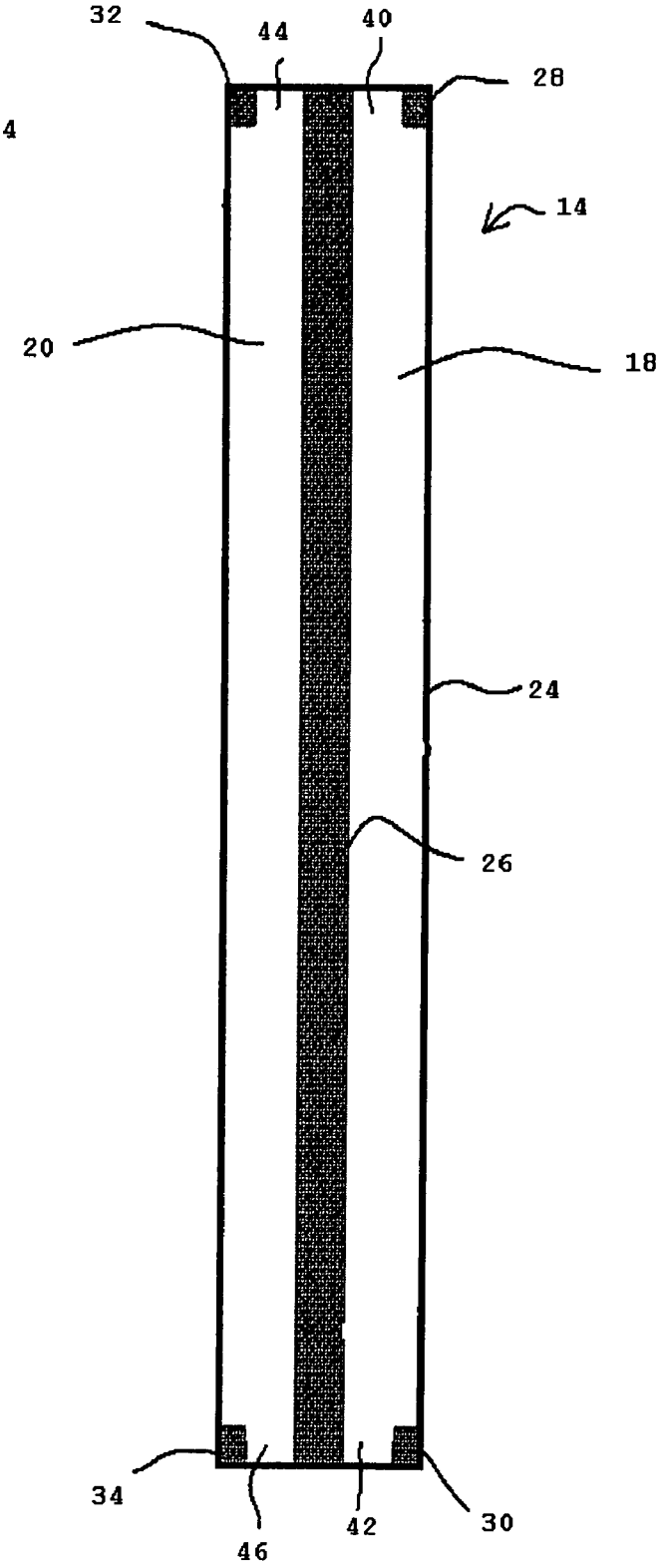
FIG. 4 is a fragmentary plane view of the bracket shown in FIG. 3.

The bracket 14 is mounted on the pole 16 to extend upwardly in a vertical direction. As shown in FIG. 4, the bracket 14 includes a pair of vertically-aligned channels 18, 20 positioned on opposite sides of the assembly 10. Each channel 18, 20 is configured to receive the sign 12 so that indicia, symbols, graphics, or other presentations for conveying information on the sign 12 are visible to a person standing alongside the pole 16 or traveling in a vehicle passing by the sign assembly 10.

Figure 2:
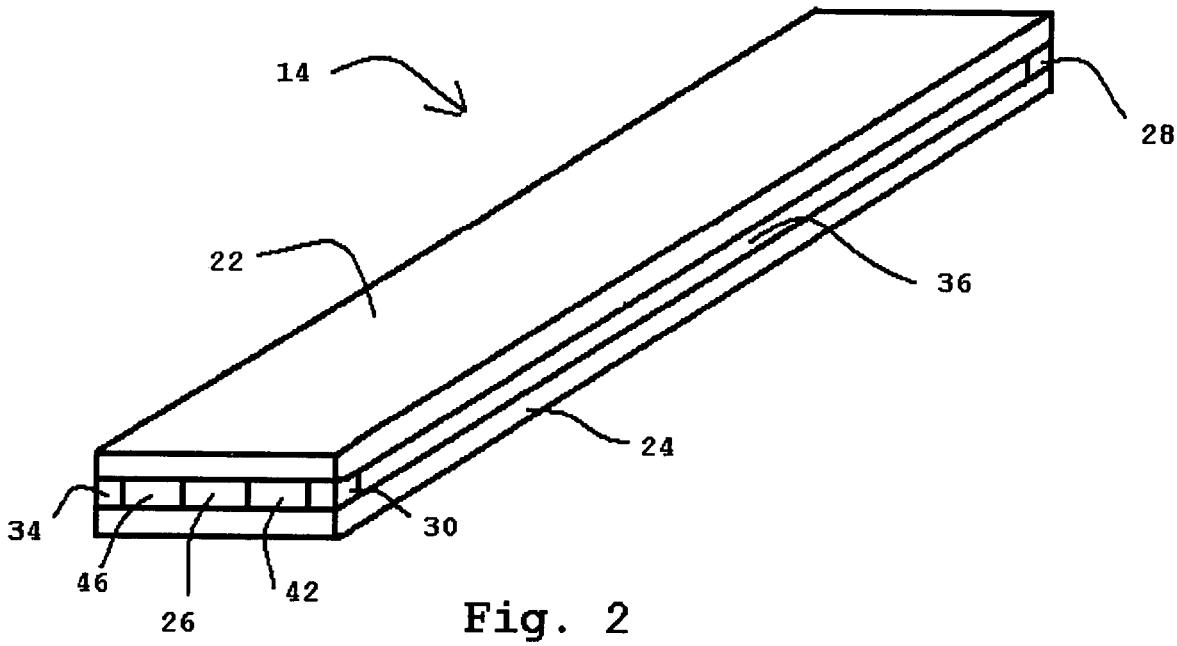
FIG. 2 is an isometric view of a bracket for receiving a sign panel.
Figure 3:
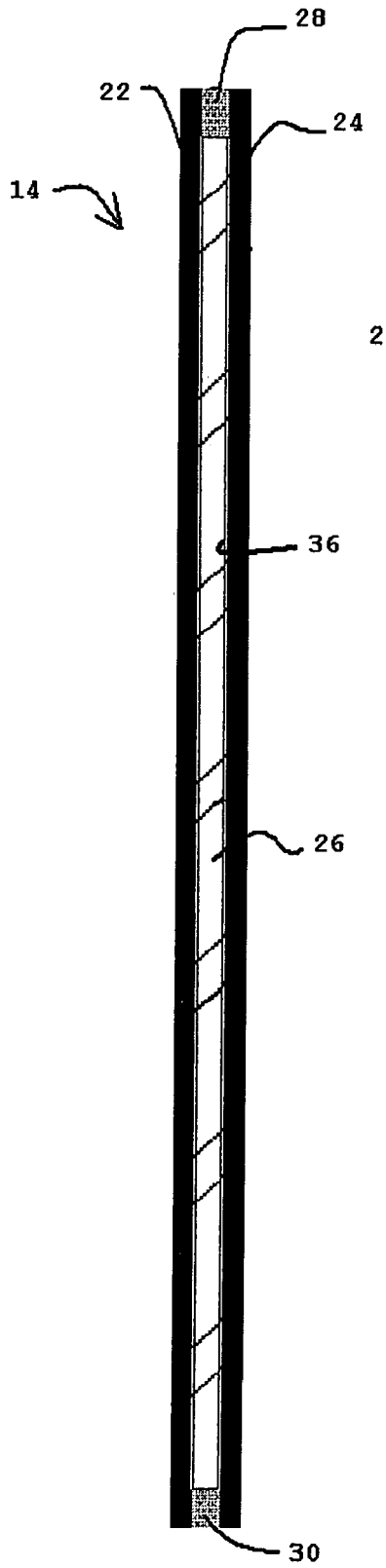
FIG. 3 is a sectional view in side elevation of the bracket.

The bracket 14 includes a pair of vertically-aligned, spaced-apart plates 22, 24, as shown in FIGS. 2 and 3, that are mounted on the support member 16 (FIG. 1) at a predetermined height to facilitate viewing of the sign 12. The bracket 14 also includes a brace or stop bar 26 positioned between the plates 22, 24. The brace 26 connects the plate 22 to plate 24 to define the channels 18, 20, as illustrated in FIG. 4. To better illustrate the channels 18, 20, the plate 22 is not shown in FIG. 4 nor in FIGS. 6-10 illustrating the steps of installing the sign 12 in the bracket 14. The channels 18, 20 are U-shaped, as shown in FIG. 3.

The bracket 14, as shown in FIG. 4, includes a plurality of blocks or stops 28, 30, 32, 34 positioned between the plates 22, 24. The combination of the brace 26 and the stops 28-34 maintain the plates 22, 24 in spaced apart overlying relationship, as shown in FIG. 2. The block 28 is positioned at one end of the channel 18. The block 30 is positioned at the opposite end of the channel 18 so that the blocks 28, 30 and the plates 22, 24 define a vertically aligned opening 36 (FIG. 2) for receiving the sign 12 along a vertical axis on one side of the bracket 14. Similarly, the blocks 32, 34 are positioned at opposite ends of the channel 20 to define another vertically aligned opening (not shown) on the opposite of the bracket 14. The opening 36 and the opposite opening each have dimensions suitable for receiving the sign 12 to extend outwardly from the bracket 14.

The stops 28, 30, 32, 34 are formed separately from the plates 22, 24. The stops 28, 30, 32, 34 connect to the plates 22, 24 through conventional fasteners or adhesives. Alternatively, the stops 28, 30, 32, 34 are integral with plates 22, 24 to form the channels 18, 20 and the openings thereto.

The stops 28, 30, 32, 34, shown in FIGS. 2-4, are essentially orthorhombic in shape. The stops 28, 30, 32, 34 facilitate connection of the sign 12 to the bracket 14. As shown in FIG. 4, the stops 28, 30 are positioned in the channel 18 in a spaced apart manner at a predetermined distance from the brace 26 to form a pair of slots 40, 42. The stops 32, 34 are positioned in the channel 20 in a spaced apart manner at a predetermined distance from the brace 26 to form a pair of slots 44, 46. The stops 28, 30, 32, 34 also connect the plates 22, 24 in spaced relation to one another.

The dimensions of the plates 22, 24, the brace 26, the stops 28, 30, 32, 34 must be selected to allow the sign 12 to fit into at least one of the channels 18, 20. Otherwise, the dimensions of the plates 22, 24, the brace 26, the stops 28, 30, 32, 34, and the sign 12 are not critical. Preferably, the brace 26 has the same thickness as the stops 28, 30, 32, 34 so that the inner surfaces of the plates 22, 24 have a uniform profile.

The plates 22, 24, the brace 26, and the stops 28, 30, 32, 34, shown in FIGS. 2-4, are made from the same material or from different materials. The plates 22, 24, the brace 26, and the stops 28, 30, 32, 34 are made by any suitable manufacturing method from any suitable material. The panel forming the sign 12 is also made from any suitable material through any suitable manufacturing method. Suitable materials include flexible, semi-flexible, rigid, or semi-rigid materials. Suitable materials also include metals, ceramics, plastics, and composites. In one embodiment, the plates 22, 24, the brace 26, and the stops 28, 30, 32, 34 are made from metal, preferably aluminum. The panel forming the sign 12 is made preferably from a flexible material. A suitable material is selected from the group of materials consisting of acrylic, aluminum, aluminum reinforced polyethylene, corrugated sheeting, such as polypropylene sheet sold under the trademark coroplast, expanded or foam high density PVC, foam core board, polystyrene foam composite, and wood products.

The sign 12, bracket 14, and pole 16 are sold separately in unassembled form. The plates 22, 24, brace 26, and stops 28, 30, 32, 34 are assembled into the bracket 14 for sale as a single unit. Alternatively, the sign 12, bracket 14, and pole 16 are sold in a kit. The plates 22, 24, brace 26, and stops 28, 30, 32, 34 are also sold in an unassembled kit form.

Figure 5:
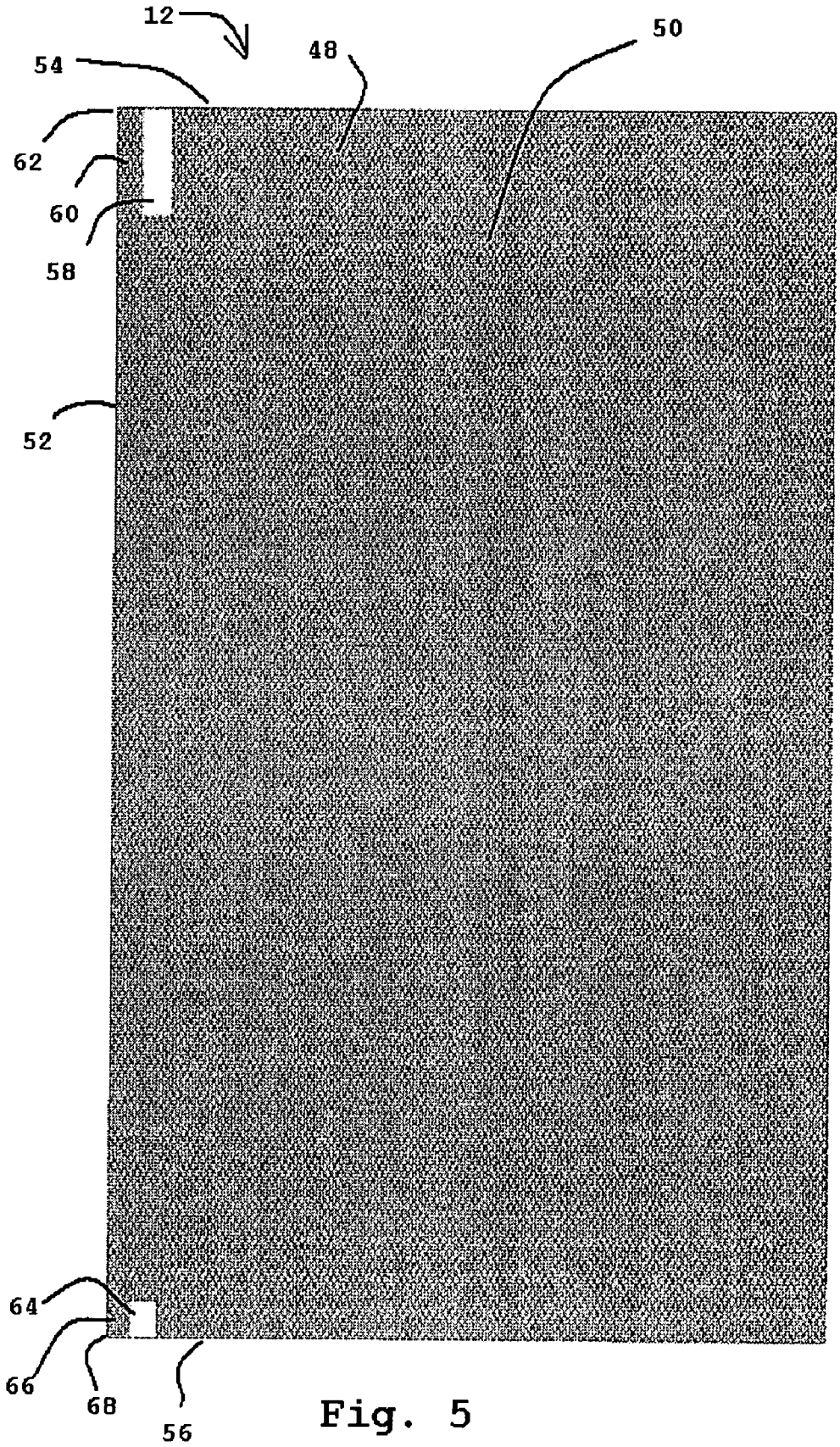
FIG. 5 is a plane view of a sign panel, illustrating a pair of tabs extending from the ends of an edge of the panel.

Referring now to FIG. 5, the sign 12 includes a fabricated panel 48 of selected material as described above and having a display section 50 bearing the indicia, symbols, graphics, or other similar information conveying matter. The display section 50 is defined by a guide edge 52, an upper tabbed edge 54, and a lower tabbed edge 56. The upper tabbed edge 54 has a notch 58 that forms an upper tab 60 at a juncture 62 with the guide edge 52. The lower tabbed edge 56 also has a notch 64 that forms a lower tab 66 at a juncture 68 with the guide edge 52.

The tabs 60, 66 are tongue-shaped members that extend from the guide edge 52 for insertion into the slots 40, 42, shown in FIGS. 6-10, to connect the sign 12 to the bracket 14. The display section 50 extends out of the bracket 14 for viewing upon insertion. The tabs 60, 66 also insert into slots 44, 46 to allow the sign 12 to be inserted into the bracket 14 from the opposite direction.

The panel 48 and the display section 50 have a suitable shape and configuration. In the embodiment shown in FIG. 5, the panel 48 and the display section 50 have the same, conventional rectangular shape. However, the shape of the panel 48 and the display section 50 is not critical.

Referring now to FIGS. 6-10, the sign assembly 10 is assembled in a series of steps in which the sign 12 is inserted into the bracket 14. The sign 12 is either inserted into the bracket 14 to form a new assembly 10, replaced with a different sign (not shown), or inserted after having the display section 50 altered in some manner with new indicia, symbols, graphics, or other information conveying matter.

The bracket 14 is attached to the support member 16, as illustrated in FIG. 1, before the sign 12 is attached to the bracket 14. Alternatively, the sign 12 is inserted into the bracket 14 before the bracket 14 is mounted on the support member 16 so that the bracket 14 and the sign 12 are mounted on the support member 16 in a single step.

Figure 6:
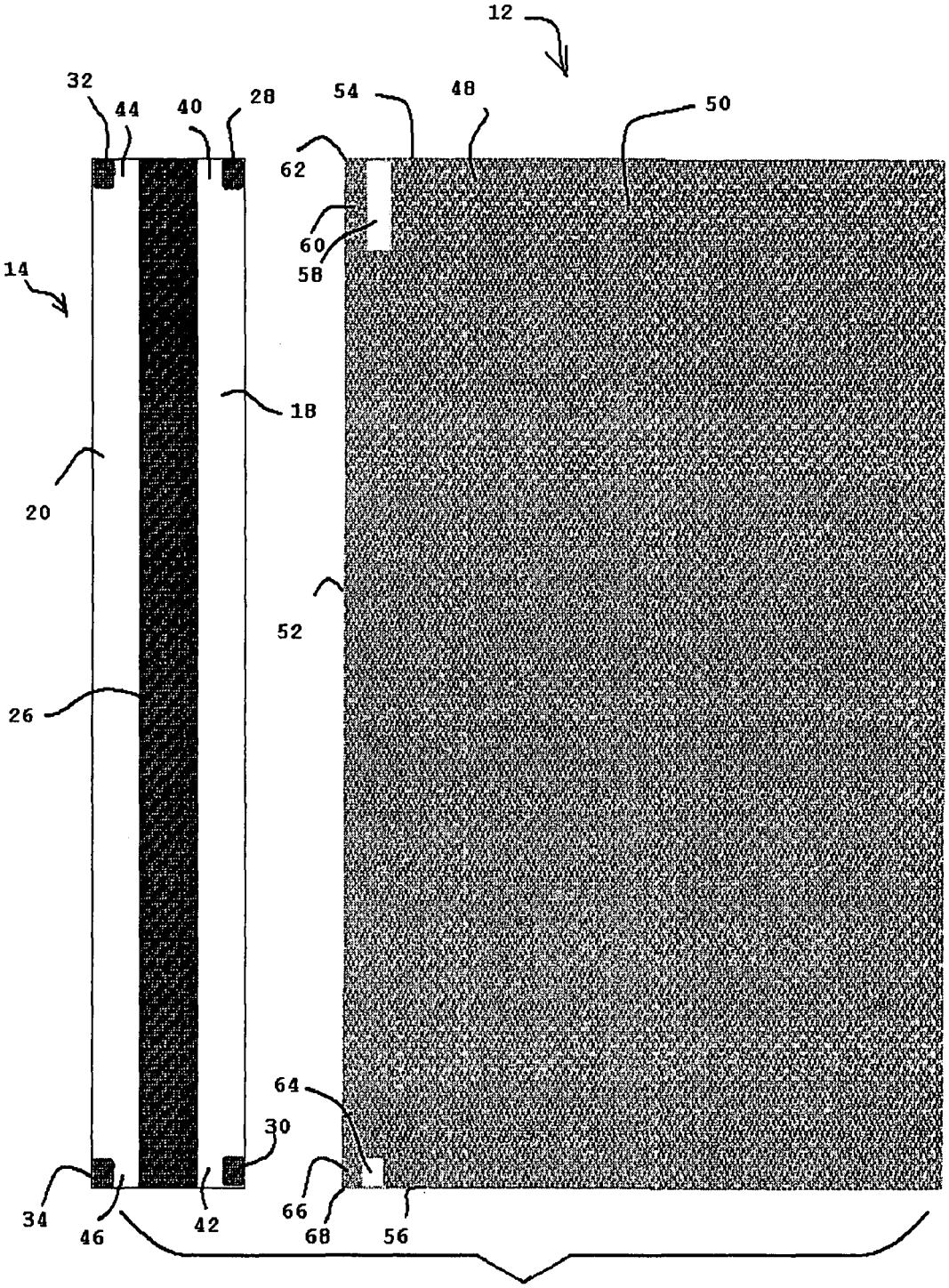
FIG. 6 is an exploded view in side elevation of the sign panel and fragmentary view of the bracket, illustrating the bracket and sign positioned for assembly.

As shown in FIG. 6, the panel 48 is raised initially to a position in alignment with the opening 36 in the bracket 14. The panel 48 and the bracket 14 are essentially positioned parallel to one another in the vertical direction and adjacent to one another in the horizontal direction. The panel guide edge is essentially parallel to the brace 26 in the bracket channel 18.

Figure 7:
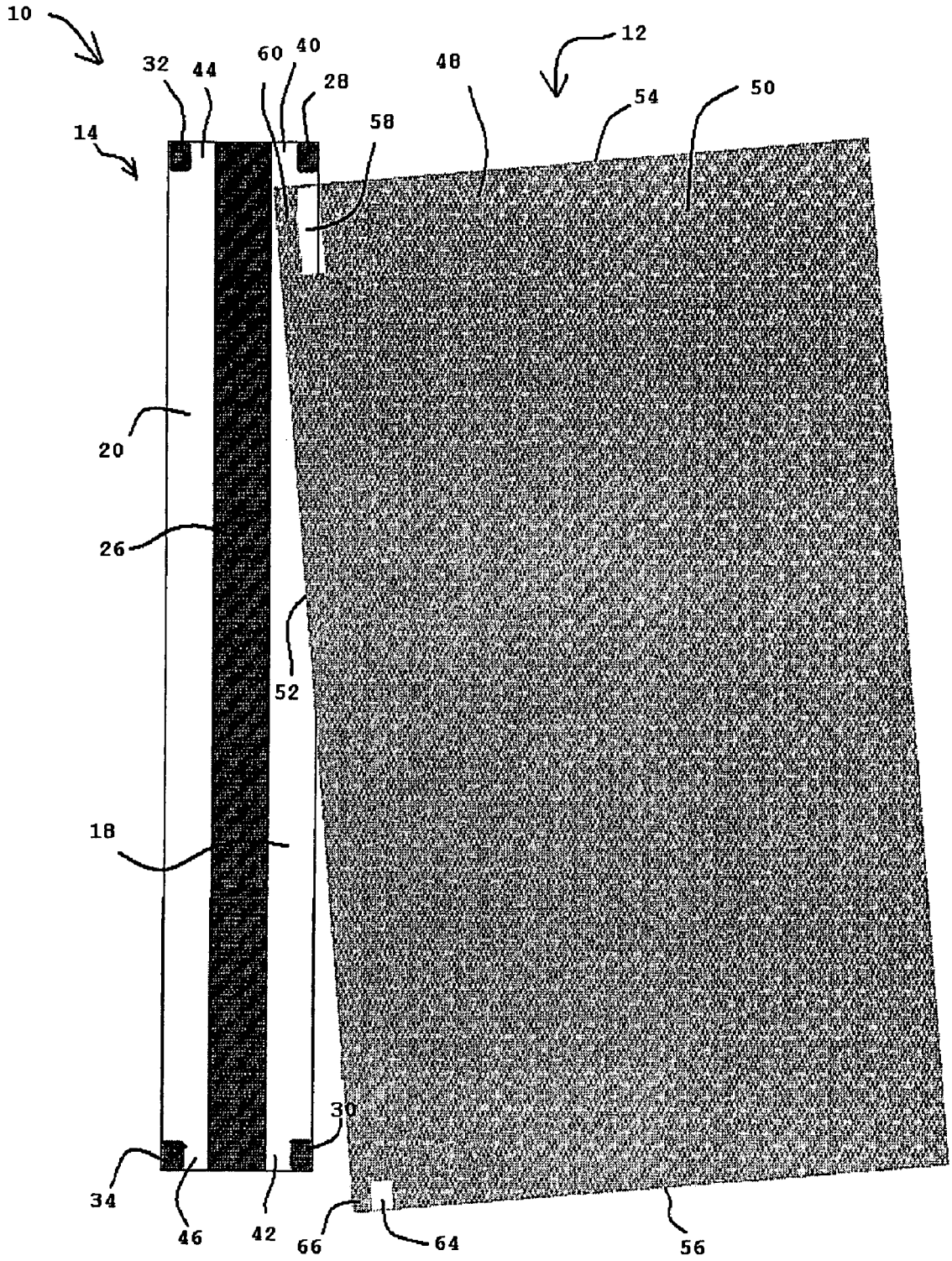
FIG. 7 is a fragmentary view in side elevation similar to FIG. 5, illustrating an upper corner of the sign panel initially inserted into a channel of the bracket.

As shown in FIG. 7, the panel 48 must be angled for insertion into the bracket 14 through the opening 36. The panel 48 is tilted so that the guide edge 52 is angled relative to the brace 26. The tilting of the guide edge 52 allows the upper tab 60 to be inserted into the channel 18 through the opening 36. The upper tab 60 is movable in the channel 18. However, the brace 26 defines the bottom of the channel 18 to restrict insertion of the panel 48 to a predetermined depth.

Figure 8:
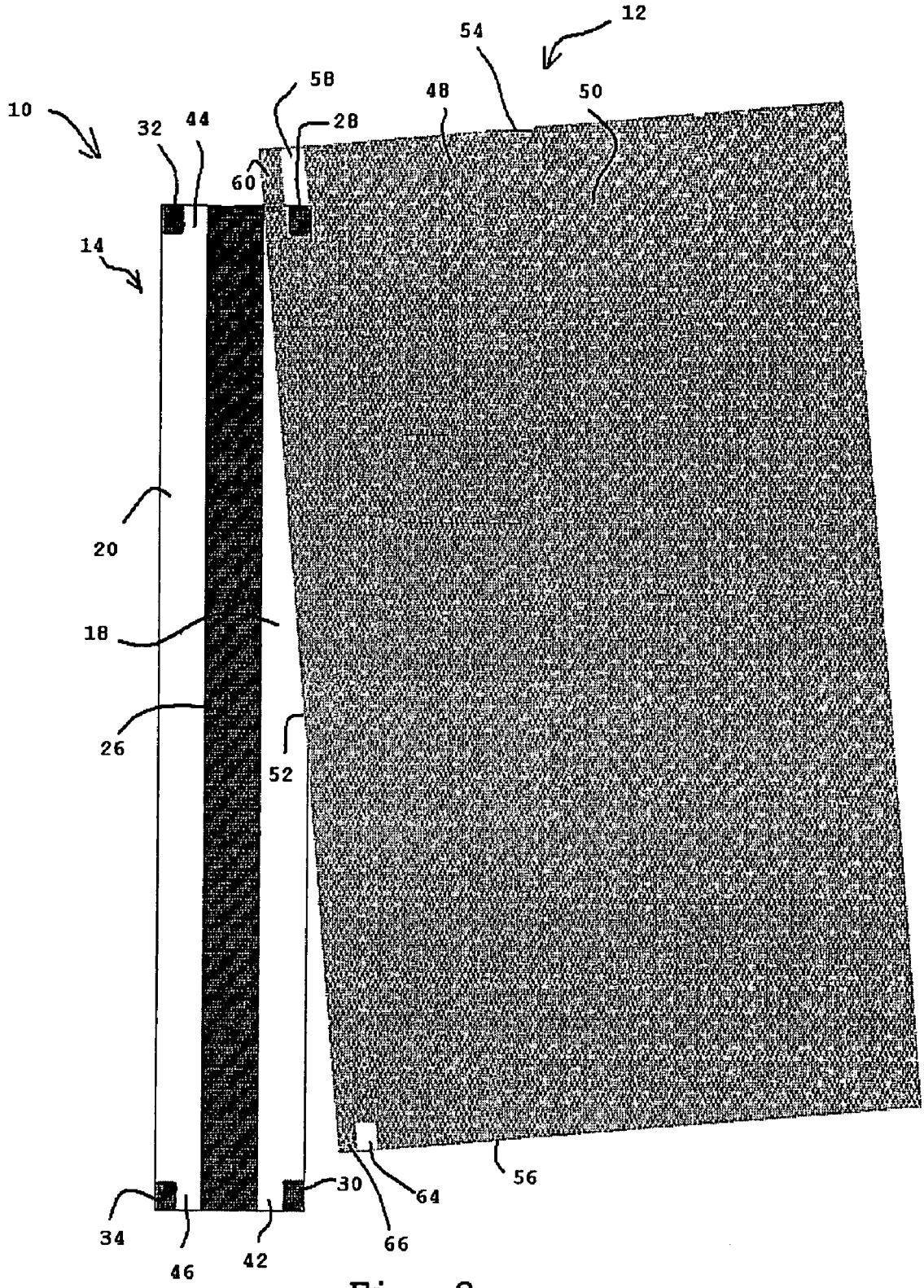
FIG. 8 is a fragmentary view in side elevation similar to FIG. 6, illustrating a slot at the upper corner of the sign panel receiving a stop on the bracket.

The panel upper tab 60 is movable in the channel 18 in the vertical direction. The upper tab 60 extends from an end of the panel 48 for vertical insertion into the slot 40. The insertion of the upper tab 60 into the slot 40 causes the stop 28 to be received in the notch 58. This connects the panel 48 to the bracket 14. The upper tab 60 slides in slot 40 a vertical direction opposite the stop 28, as shown in FIG. 8.

Upon positioning of the stop 28 in the notch 58, the tab 60 guides the notch 58 to receive the stop 28. The stop 28 frictionally engages the edges of the notch to retain the panel 48 in the bracket 14. The panel 48 is rotated slightly to allow the stop 28 to engage the bottom of the notch 58, as shown in FIG. 8.

Figure 9:
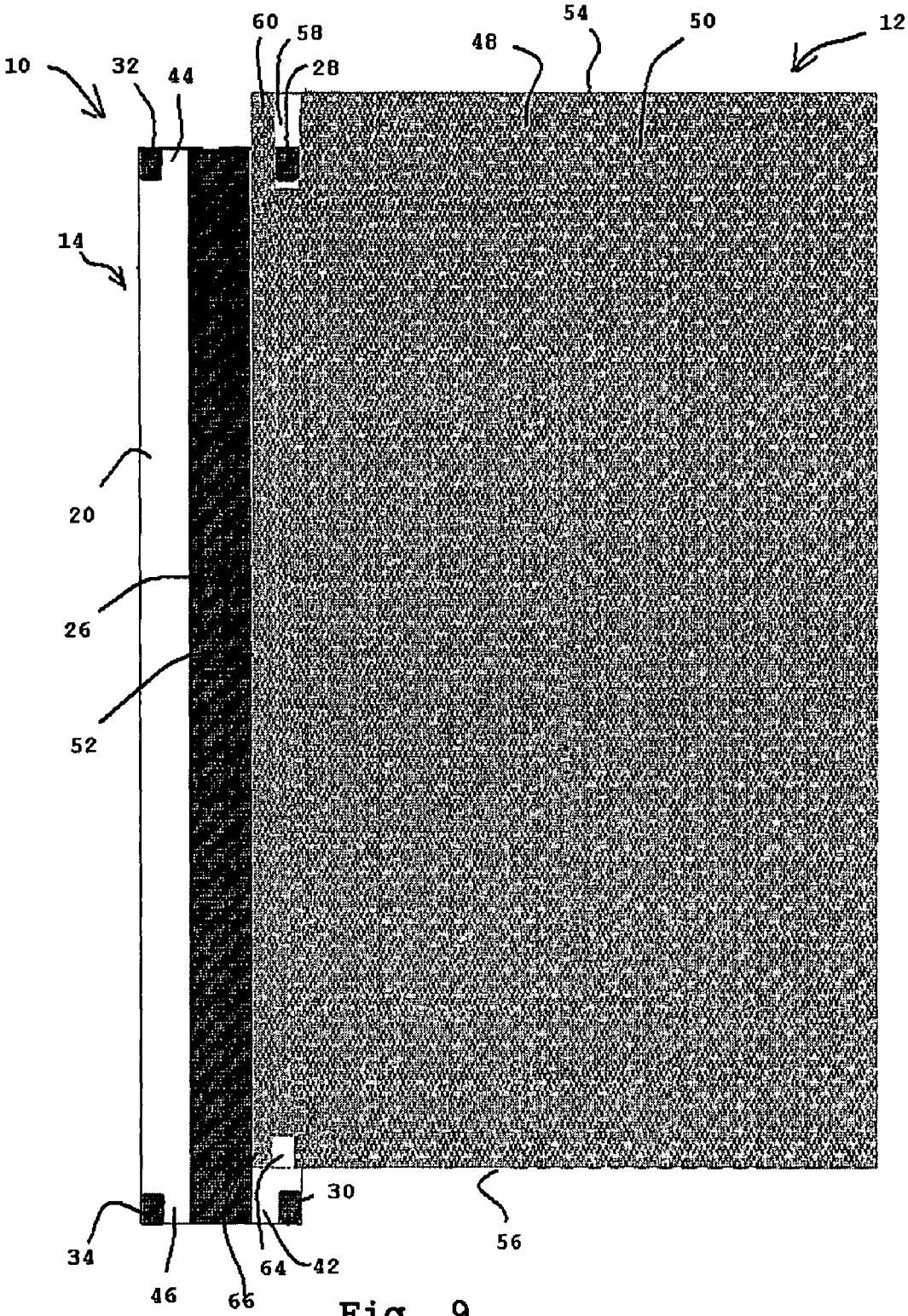
FIG. 9 is a fragmentary view in side elevation of the edge of the sign panel completely inserted in the bracket channel, illustrating a stop positioned in an upper slot and a stop aligned to be received in a lower slot of the sign panel.
Figure 10:
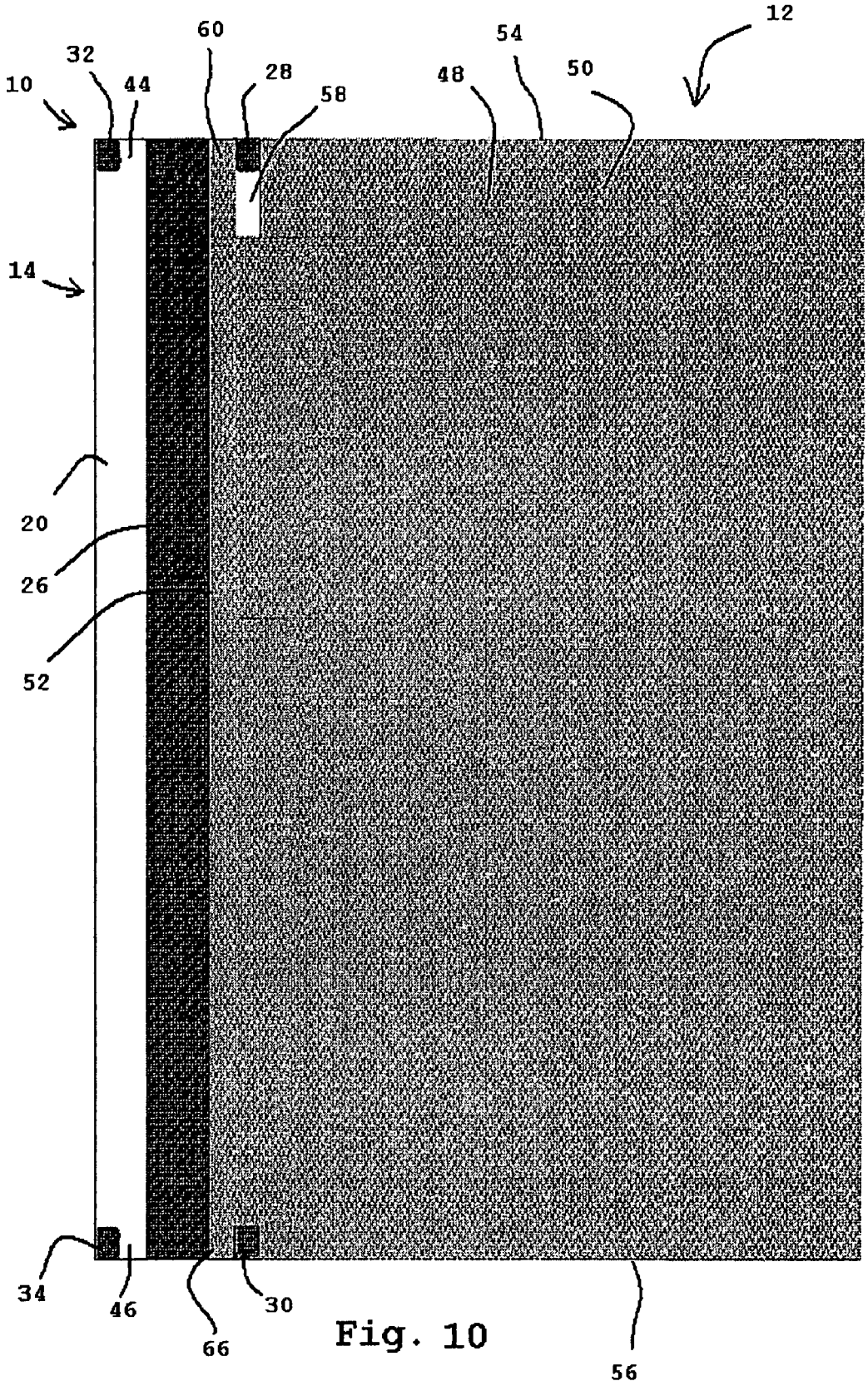
FIG. 10 is a fragmentary view in side elevation of the sign panel completely assembled in the bracket.

As shown in FIG. 9, the panel 48 continues to rotate until the guide edge 52 is essentially aligned vertically with the brace 26 in the channel 18. Preferably, the guide edge 52 rotates until it is aligned vertically and is parallel with the brace 26. The guide edge 52 also abuts the bottom of the channel 18, which is defined by the brace 26. Preferably, the brace 26 is contoured to frictionally engage the guide edge 52 to prevent displacement of the panel 48 from the bracket 14.

The rotation of the panel 48 to abut the brace 26 also aligns the notch 64 with the stop 30 at the bottom of the panel 48. Upon alignment of the notch 64 with the stop 30, the panel is moved in an essentially downward direction along a vertical axis sliding against the brace 26. The brace 26 guides the panel 48 within the channel 18 to prevent displacement of the sign 12 from the bracket 14. The brace 26 also prevents further rotation of the panel 48.

The lower tab 66 extends from the lower tabbed edge 56 to guide the notch 64 to receive the stop 30. The panel 48 continues to move in an essentially vertical direction to insert the tab 66 into the slot 42. The insertion of the tab 66 into the slot 42 causes the stop 30 to be received in the notch 64. The panel 48 continues to move in the vertical direction until the stop 30 contacts an upper end of the notch 64.

The distance between the stops 28, 30 must be less than the height of the panel 48 to ensure that the stops 28, 30 do not slide out of the notches 58, 64. Preferably, the notch 58 is substantially deeper than the notch 64 to allow the panel 48 to facilitate rotation of the guide edge 52 in the channel 18.

In high winds, the display section 50 will apply a horizontal force on tabs 60, 66. However, the stops 28, 30 will oppose the horizontal force to retain the panel 48 in the bracket channel 18.

It should be understood that alternative embodiments are contemplated in accordance with the present invention and include embodiments in which a sign is inserted into each channel of the bracket so that indicia, symbols, graphics, or other similar matter for conveying information are displayed on both sides of the bracket. Also, it should be understood that alternative embodiments are contemplated in accordance with the present invention and include embodiments in which a plurality of signs extend from a plurality of channels in the bracket 14.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A bracket for displaying a sign comprising:

a pair of plates positioned in spaced overlying position, a brace positioned between and connected to said plates forming a channel between said plates, said plates being spaced a preselected distance apart to form an opening to said channel for receiving the sign, a pair of stops positioned in said channel for connecting said plates to one another, said stops positioned in spaced relation at a predetermined distance from said brace to form a slot between each stop and said brace and accessible through said opening, and each of said slots adapted to receive in said channel through said opening an edge of the sign in abutting relation with said stop to retain the sign within said channel.

2. A bracket as set forth in claim 1 in which:

said stop have the same thickness as said brace.

3. A bracket as set forth in claim 1 which includes:

a second pair of stops secured in said channel oppositely of said first mentioned pair of stops in spaced relation at a predetermined distance from said brace to form a slot between each of said second pair of stops and accessible through said opening, said brace being positioned in the middle of said plates to form a second channel oppositely of said first mentioned channel, and said second pair of stops secured in spaced relation in said second channel a predetermined distance from said brace to form a slot between each of said second pair of stops and said brace and accessible through said opening between said plates to receive a second sign.

4. A bracket as set forth in claim 1 which includes:

said plates being fabricated from a preselected flexible material.

5. A sign comprising:

a panel having a display section defined by a guide edge, an upper tabbed edge, and a lower tabbed edge, said upper tabbed edge having a notch forming an upper tab at a juncture with said guide edge, said lower tabbed edge having a notch forming a lower tab at a juncture with said guide edge, a pair of plates positioned in spaced overlying relation, a bracket positioned between said pair of plates forming a channel for receiving said panel, said guide edge adopted for insertion into said bracket channel in abutting relation with the bottom of said channel, said upper tab being movable within said channel to abut a first stop positioned within said channel and connected to said pair of plates, said lower tab being movable within said channel to abut a second stop positioned within said channel and connected to said pair of plates, and said upper tab and said lower tab frictionally engaging said first stop and said second stop respectively to retain said panel in said channel.

6. A sign as set forth in claim 5 which includes:

said upper tabbed edge notch receiving said first stop, and said lower tabbed edge notch receiving said second stop.

7. A sign as set forth in claim 5 which includes:

said upper tab being substantially longer than said lower tab so that said upper tabbed edge notch is substantially deeper than said lower tabbed edge notch.

8. A sign as set forth in claim 5 which includes:

said panel being fabricated from a material selected from the group consisting essentially of acrylic, aluminum, aluminum reinforced polyethylene, corrugated sheeting, polypropylene, expanded high density PVC, foam core board, polystyrene foam composite, and wood products.

9. A sign assembly comprising:

a support member, a pair of plates positioned in spaced overlying relation to form a bracket, said bracket connected to said support member, said plates forming a longitudinally extending channel with a pair of stops positioned in said channel between said plates, said stops in said channel connecting said plates to one another, a panel having a display section, a guide edge, and a pair of tabs positioned at opposite sides of said guide edge to define a pair of vertical notches, said guide edge being movable within said bracket channel to position said tabs for alignment of said notches with said stops, and said stops positioned in said notches with said abutting said bracket at the bottom of said channel to secure said panel to said bracket with said display section extending outwardly from said bracket.

10. A sign assembly as set forth in claim 9 in which:

said bracket includes a pair of sheets positioned in spaced overlying relation with a brace positioned between and connecting said sheets.

11. A sign assembly as set forth in claim 10 which includes:

a second panel, and said brace being positioned in the center of said sheets to form a second channel for securing said second panel to said bracket.

12. A sign assembly as set forth in claim 10 which includes:

said panel being fabricated from a material selected from the group consisting essentially of acrylic, aluminum, aluminum reinforced polyethylene, corrugated sheeting, polypropylene, expanded high density PVC, foam core board, polystyrene foam composite, and wood products.

13. A sign assembly as set forth in claim 10 which includes:

said guide edge being contoured to abut said brace to prevent displacement of said panel after said notches receive said stops.

14. A sign assembly as set forth in claim 9 which includes:

said panel being positioned in said bracket with said display section being visible.

15. A method for assembling a display apparatus comprising the steps of:

positioning a pair of plates in spaced overlying relation to form a bracket with a channel between the plates, positioning a first stop and a second stop at opposite ends of the channel to connect the plates to one another, inserting a first tab extending from one end of a panel into the channel of the bracket to align a first notch adjacent to the first tab with the first stop positioned at one end of the channel, guiding the first tab in the channel to position the first stop in the first notch, rotating the panel to align a second tab on the opposite end of the panel with the second stop positioned at the opposite end of the channel, moving the panel to insert the second stop into a second notch in the panel adjacent to the second tab, and extending the panel from the channel so that a substantial portion of the panel is visible while the first tab and the second tab are retained in the channel.

16. A method as set forth in claim 15 which includes:

inserting the panel in the channel until the edge of the panel abuts an inner edge of the channel and prevents displacement of the panel in the channel.

17. A method as set forth in claim 15 which includes:

sliding the panel in the bracket channel until the bottom of the first notch touches the first stop.

18. A method as set forth in claim 15 which includes:

sliding the panel in the bracket channel to allow the second tab to guide the second notch to receive the second stop.

19. A kit for assembling a sign comprising:

a bracket having a pair of sheets positioned in spaced overlying relation, a pair of stops, and a brace positioned between and connecting said sheets to one another, said bracket sheets and said bracket stops defining a channel therein, said stops in said bracket channel connecting said sheets to one another, a panel having a display section and a guide section, said guide section including a pair of tabs positioned at opposite ends of said panel to define a pair of notches, and said notches having a predetermined width to receive said bracket stops after said panel guide section inserts into said bracket channel.

20. A kit as set forth in claim 19 in which includes:

a support member.

21. A kit as set forth in claim 19 which includes:

a second panel, and said brace being positioned in the center of said sheets to form a second channel for retaining said second panel.

22. A kit as set forth in claim 19 which includes:

said panel being fabricated from a material selected from the group consisting essentially of acrylic, aluminum, aluminum reinforced polyethylene, corrugated sheeting, polypropylene, expanded high density PVC, foam core board, polystyrene foam composite, and wood products.

23. A kit as set forth in claim 19 which includes:

said guide section being contoured to abut said brace to prevent further displacement of said panel after said notches receive said bracket stops.

* * * * *